United States Patent [19]

Furukawa

[11] Patent Number: 4,579,467

[45] Date of Patent: Apr. 1, 1986

[54] DOT PRINTER WITH PREDRIVING FORCE FOR REMOVING PARTICLES FROM DOT PINS

[75] Inventor: Fuminobu Furukawa, Otokuni, Japan

[73] Assignee: Omron Tateisi Electronics Co., Kyoto, Japan

[21] Appl. No.: 698,265

[22] Filed: Feb. 5, 1985

Related U.S. Application Data

[63] Continuation of Ser. No. 419,565, Sep. 17, 1982, abandoned.

[30] Foreign Application Priority Data

| | | | |
|---|---|---|---|
| Sep. 21, 1981 | [JP] | Japan | 56-149841 |
| Sep. 22, 1981 | [JP] | Japan | 56-151118 |
| Sep. 22, 1981 | [JP] | Japan | 56-151120 |
| Sep. 24, 1981 | [JP] | Japan | 56-151155 |

[51] Int. Cl.[4] ..... B41J 3/10; B41J 29/00

[52] U.S. Cl. ..... 400/124; 400/54; 400/701

[58] Field of Search ..... 400/54, 124, 74, 701, 400/702, 703; 101/93.05

[56] References Cited

U.S. PATENT DOCUMENTS

| | | | |
|---|---|---|---|
| 4,179,223 | 12/1979 | Kwan | 400/124 X |
| 4,184,781 | 1/1980 | Ota | 400/124 |
| 4,252,448 | 2/1981 | Johnson et al. | 400/701 X |
| 4,339,208 | 7/1982 | Biedermann | 400/124 |

FOREIGN PATENT DOCUMENTS

| | | | |
|---|---|---|---|
| 84987 | 7/1981 | Japan | 400/124 |

*Primary Examiner*—Paul T. Sewell

*Attorney, Agent, or Firm*—Schwartz, Jeffery, Schwaab, Mack, Blumenthal & Evans

[57] ABSTRACT

A dot printer is adapted to make test printing by driving dot pins (161 to 167) included in a print head (16) before the first character is printed out. More specifically, a central processing unit (1) makes evaluation of the value of a period of approximately one-third of the period required for depression of a printing sheet by the dot pins, thereby to provide the same to an input/output port (6), before print control data for printing the first character is outputted. The input/output port is responsive to the output from the central processing unit to provide a printer driver (9) with a print timing signal of the pulse width of approximately one-third of the pulse width of the print timing signal required for printing the characters. The print driver is responsive to the applied print timing signal to drive the dot pins. As a result, the dot pins are driven for a time period shorter than the period of the normal dot timing signal and therefore the tip ends thereof are brought to a stop immediately before depression of the print sheet. Accordingly, ink left around the dot pins can be removed without leaving any print out on the print sheet.

13 Claims, 22 Drawing Figures

DOT PRINTER WITH PREDRIVING FORCE FOR REMOVING PARTICLES FROM DOT PINS

This application is a continuation, of application Ser. No. 419,565, filed 09/17/82, abandoned.

BACKGROUND OF THE INVENTION

1. Field of the Invention

The present invention relates to a dot printer. More specifically, the present invention relates to an improvement in such a dot printer as a wire dot printer for use in a slip issuing machine wherein character data is printed through depression of dot pins onto a print medium.

2. Description of the Prior Art

A conventional dot printer is structured to print characters to be printed by decomposing the same into a combination of dots. For example, a wire dot printer comprises a print head for dot printing including a plurality of dot pins arranged in one column, which is adapted such that the dot pins are driven in accordance with character data so that the tip ends of the corresponding dot pins are depressed onto a print medium while the print head is moved in the lateral direction. Such dot printer is usually adapted such that an ink ribbon is interposed between a print head and a print medium so that the portions of the print medium which are depressed by the dot pins become blotted with the ink of the ink ribbon, whereby the corresponding dots are printed. In the case where a so-called pressure sensitive coloring sheet is employed as a print medium, the portions of the print medium which are depressed by the dot pins become colored, whereby the dots are printed. In such a case, no ink ribbon is required as a matter of course.

In case where such a ink ribbon as described above is employed, an ink of the ink ribbon is dispersed due to depression by the dot pins, whereby dispersed ink could enter between the dot pins and a guide enclosing therearound. If and when a dot printer has not been used for a long period of time in such a situation, the ink between the dot pins and the guide solidifies, which makes it difficult for the dot pins to be driven smoothly. As a result, malfunction in printing is liable to occur, for example, the dots to be printed are not properly printed. Furthermore, in the case where such a pressure sensitive coloring sheet as described above is utilized, coloring powder coated on the surface of the pressure sensitive coloring sheet and a paper dust are dispersed due to depression by the dot pins and those adhere to the periphery of the dot pins. In such case as well, the adhering material around the dot pins solidify during a long period of time when the dot printer is not utilized, which makes it difficult for the dot pins to be smoothly moved. As a result, malfunction in printing becomes liable to occur.

SUMMARY OF THE INVENTION

Accordingly, a principal object of the present invention is to provide a dot printer adapted for making test printing of dot pins before printing of the first character, thereby to remove the ink and the like adhering to the periphery of the dot pins and to make the dot pins be smoothly driven.

Another object of the present invention is to provide a dot printer which is capable of making a test print operation by dot pins without leaving print out on a print medium.

Briefly described, the present invention comprises a dot printer for printing characters by moving a print head having a plurality of dot pins arranged in a first direction into a second direction and by depressing the respective dot pins onto a print medium, characterized in that a test print operation is performed by applying a predetermined driving force to the dot pins immediately before the first character is printed.

Therefore, according to the present invention, a test print operation is made of the dot pins before the first character is printed and therefore unrequired ink adhering to the periphery of the dot pins can be removed by the test print operation and the dot pins can be smoothly driven on the occasion of printing of the characters, thereby to eliminate malfunction in printing.

In a preferred embodiment of the present invention, a driving force required for printing characters on a print medium is applied to the dot pins for the purpose of a test print operation, immediately before the first character is printed.

According to the preferred embodiment of the present invention, since the driving force as large as required for printing characters is applied to the dot pins for the purpose of a test print operation, an assured test print operation can be performed.

In another preferred embodiment of the present invention, a test print operation is performed by driving the dot pins for period of time shorter than the period of time required for printing a character by depressing the dot pins onto a print medium immediately before the first character is printed.

In a further preferred embodiment of the present invention, the dot pins are test printed by a relatively small driving force, whereby the dot pins are brought to a stop immediately before depression of a print medium, with the result that an undesired print out is prevented from being made.

In still a further preferred embodiment of the present invention, the dot pins are driven for test printing only during a period of time shorter than the period of time required for depression of a print medium by the dot pins, immediately before the first character is printed, while a print head is in a standstill state at the position of a margin outside an ordinary printing region of the print sheet where the characters are to be printed. According to the embodiment in discussion, therefore, the dot pins are driven for testing with the print head kept in a standstill state at the position of a margin outside an ordinary printing region of the print medium and as a result the print head is prevented from passing the margin portion to reach an ordinary printing region by the test print operation in the case of a small margin and as a result the first character can be printed at a predetermined position of the printing region without returning the print head to an initial position after making a test print operation of the dot pins.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
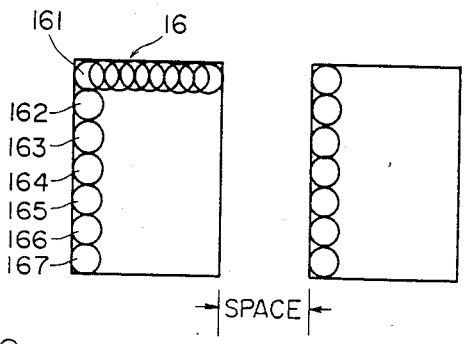
FIG. 1 is a view for explaining an arrangement of the dot pins wherein one embodiment of the present invention can be advantageously employed.

FIG. 1 is a view for explaining an arrangement of the dot pins for use in one embodiment of the present invention. Referring to FIG. 1, a print head 16 comprises seven dot pins 161 to 167 arranged in a first direction or in a column direction and is adapted to move in a second direction or in a row direction for nine shifts for printing one character. More specifically, one character is printed while nine columns of dot pins are printed by shifting the column arrangement of dot pins in succession into nine positions spaced apart by a half of the dot pin distance. The next digit character is printed out with a spacing of five columns. After a predetermined number of digits or characters are printed out, the print head 16 is returned to the initial position, while the print sheet is fed forward, whereupon a print operation of the next line is started.

Figure 2:
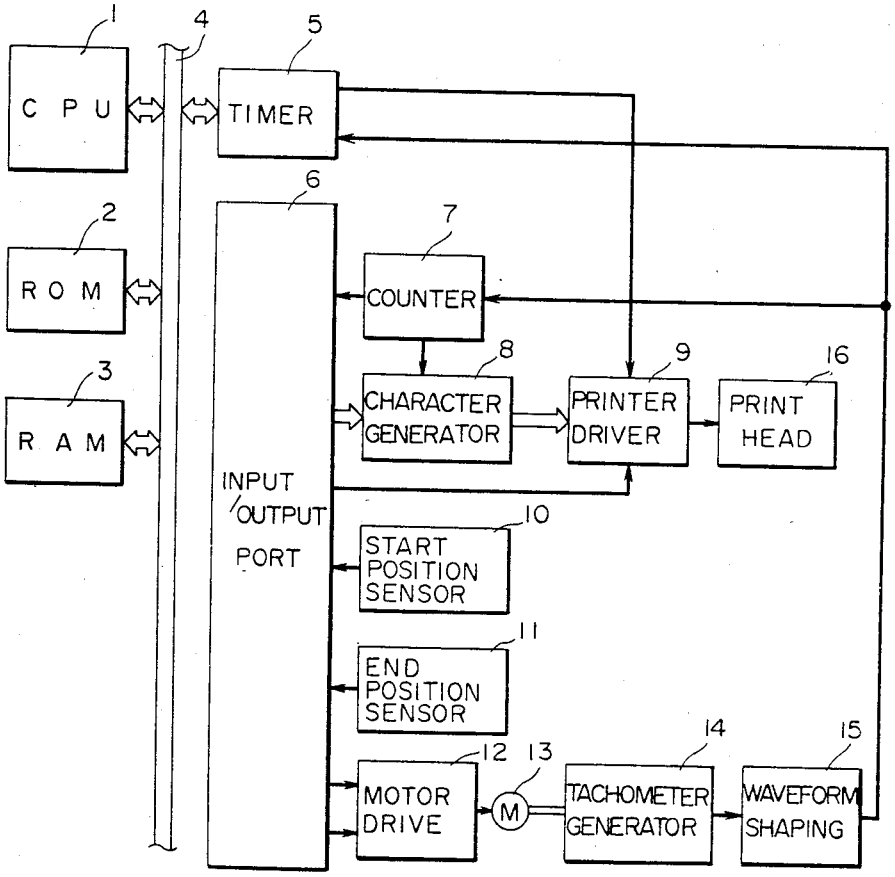
FIG. 2 is a block diagram of one embodiment of the present invention.

FIG. 2 is a block diagram showing a control circuit of a dot printer for use in a slip issuing machine of one embodiment of the present invention. Referring to FIG. 2, a central processing unit 1 included in the slip issuing machine is adapted to make a print operation by controlling the dot printer in accordance with a program stored in a read only memory 2. The central processing unit 1 is coupled through a data bus 4 to a random access memory 3, a timer 5 and an input/output port 6 as well as to the above described read only memory 2. The random access memory 3 is used for storing print data which is to be printed by the dot printer. The print data stored in the random access memory 3 is read out by the central processing unit 1 and is applied to the input/output port 6. The input/output port 6 is coupled to a start position sensor 10 and an end position sensor 11. The start position sensor 10 is used for detecting the start position of the print head 16 and the end position sensor 11 is used for detecting the position where the printing of the data at each line of the print sheet is ended. The central processing unit 1 is supplied with a detected signal from the start position sensor 10 and the end position sensor 11 through the input/output port 6, thereby to determine in which direction, leftward or rightward, the print head 16 is to be moved. The central processing unit 1 is responsive to the determination result to provide a motor control signal to a motor drive circuit 12 through the input/output port 6. The motor drive circuit 12 is responsive to the motor drive signal to determine the rotational direction of a motor 13. The motor 13 serves to move the print head 16 leftward or rightward.

The motor 13 is directly coupled to a tachometer generator 14 so that the tachometer generator 14 provides an output signal associated with the rotational speed with the motor 13. The above described output signal is applied to a waveform shaping circuit 15 and is waveform shaped to a pulse signal. It is adapted such that the pulse signals thus obtained each correspond to one dot in printing of the dot pins. The pulse signal constituting the output of the waveform shaping circuit 15 is applied to the counter 7 and the timer 5. The counter 7 counts the number of pulse signals to provide the count value to a character generator 8 as a count signal for decomposing the print data of one character into dots. The counter 7 also provides a print digit signal representing completion of printing of one character to the input/output port 6.

The timer 5 determines a time period suitable for depression of the print sheet by the dot pins by counting the above described pulse signals and provides the count output representing the suitable time period thus obtained to the printer driver 9 as a print timing signal. The print control data read from the random access memory 3 is applied through the input/output port 6 to the character generator 8. The character generator 8 is responsive to the count output signal received from the counter 7 to provide the character data decomposed to the dots to a printer driver 9. The printer driver 9 is responsive to the character data and the print timing to drive the necessary dot pins out of the dot pins of the print head 16, whereby a print operation of one character is performed.

Figure 3:
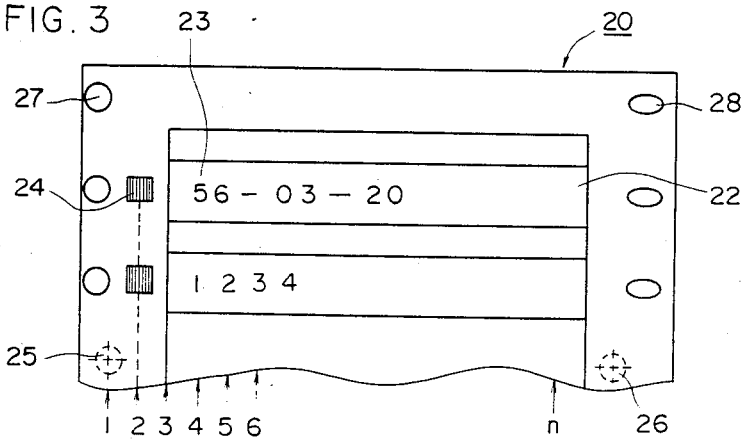
FIG. 3 is a view showing one example of a print sheet for use in one embodiment of the present invention.

FIG. 3 is a view showing one example of a print sheet for use in one embodiment of the present invention. Referring to FIG. 3, any necessary printing format 22 has been printed in advance in a slip sheet 20 and the characters 23 are printed in the printing format 22 by means of the dot printer. The start position sensor 10 and the end position sensor 11 shown in FIG. 2 are disposed at the positions in the slip 20 shown in FIG. 3 corresponding to the start position 25 and the end position 26, respectively. Sprocket perforations 27 and 28 performed at opposite sides of the slip 20 for feeding the same. Meanwhile, the position of the first character being printed in the printing format 22 comes to the third digit positions, while the first and second digit positions come to a margin or outside a printing region. However, since a frame is printed in advance as a printing format to indicate the third digit position, the third digit position is not used for printing any character.

In the case where characters of the first line are printed on the slip 20, the following operation is performed. More specifically, the print head 16 is normally stopped at the start position 25. A forward rotation signal is then applied to the motor 13 shown in FIG. 2 in such a state, whereby the print head 16 is moved in the printing direction to reach the first print position, i.e. the fourth digit position. When the print head 16 reaches the print position, the print data is applied, thereby to start a print operation. When a print operation for a necessary number of print positions is completed, the motor 13 is further continually moved so that the print head 16 may be brought to a stop at the end position 26. Then the print head 16 is again returned to the start position 25 to be ready for a print operation of the next line, while the print sheet 20 is fed by one line.

Figure 4:
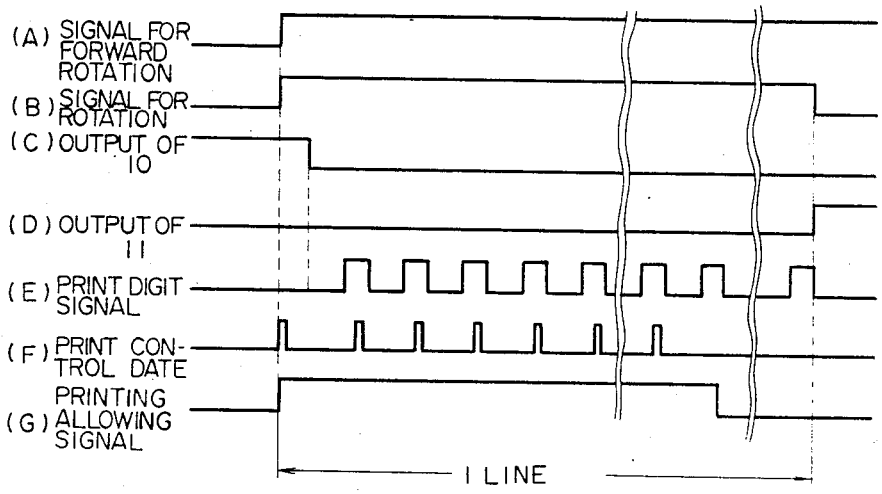
FIGS. 4 and 5 are graphs showing waveforms of the signals at various portions in the FIG. 2 embodiment.
Figure 5:
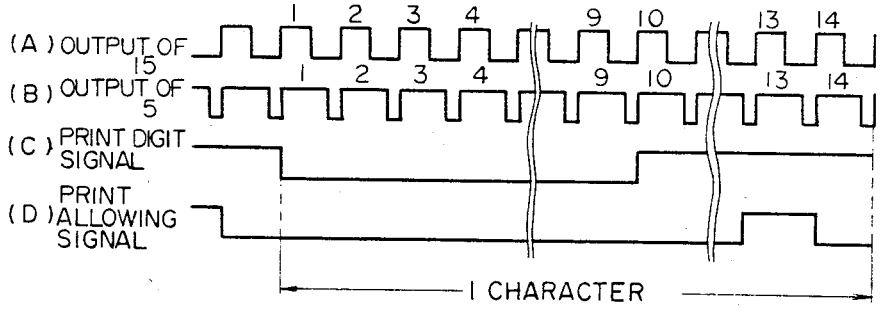

FIGS. 4A and 4B are waveforms of the electrical signals at various portions in the FIG. 2 embodiment and FIG. 5 is a flow diagram for explaining a specific operation of one embodiment of the present invention. Now a specific operation of one embodiment of the present invention will be described with reference to FIGS. 1 to 5.

The embodiment shown is adapted such that a test print operation is made using the dot pins 161 to 167 at a margin portion between the sprocket perforations 27 and the print format 22, before the first character 23 is printed in the print format 22 of the print sheet 20 shown in FIG. 3, whereby unnecessary ink and other things adhering to the periphery of the respective dot pins are removed. More specifically, in an initial state, the print head 16 has been brought to a stop at the location slightly dislocated leftward in FIG. 3 as compared with the start position 25, due to a slight overrun which occurred when the print head 16 returned to the start position 25. Therefore, as shown as (C) in FIG. 4, the output of the start position sensor 10 has become the high level. At the step SP1, the central processing unit 1 provides to the motor driving circuit 12 a forward rotation enabling signal shown as (A) in FIG. 4 and a rotation enabling signal as shown as (B) in FIG. 4. It is pointed out that in the figures showing the flow diagrams in the present application the step is designated as "SP". Accordingly, the motor driving circuit 12 drives the motor 13. As a result, the print head 16 starts moving rightward in FIG. 3 from the position left of the start position 25. At the step SP2, the central processing unit 1 provides the print control data representing a blank (non-print) to the character generator 8 (see (F) in FIG. 4). At the step SP3, the central processing unit 1 provides a print allowing signal shown as (G) in FIG. 4 to the printer driver 9. At the step SP2, the central processing unit 1 is placed in a standby state until a print digit signal is received at the input/output port 6 from the counter 7. The print digit signal assumes the low level for the time period for printing a character, i.e. a time period corresponding to nine pulses obtained from the waveform shaping circuit 15 and assumes the high level for a blank period between two adjacent character, i.e. a time period corresponding to five pulses obtained from the waveform shaping circuit 15, as shown as (C) in FIG. 5. The print head 16 is moved in accordance with the rotation of the motor 13, as described previously, to reach the first digit print position; however, no print operation is performed at the first digit print position since the character generator 8 has been supplied with the print control data for a blank.

Now the central processing unit 1 is responsive to the count value in the counter 7 to determine at the step SP5 whether the print digit signal is for the second or less significant digit. When the central processing unit 1 determines that the print digit signal is for the first digit position, then a test print control data for performing a test print (hereinafter referred to as a preprint) using the dot pins 161 to 167 is supplied to the character generator 8. Accordingly, the character generator 8 provides to the printer driver 9 the preprint data representing a print operation using all the dots of the print head 16. Meanwhile, the timing when the print control data is applied to the character generator 8 is selected to be a blank period in the print digit signal of the digit immediately before. The printer driver 9 is supplied with the print allowing signal and the print digit signal and is further supplied with the preprint data from the character generator 8, thereby to drive the dot pins 161 to 167. Since the print head 16 is moving at that time, all the dots of $7\times9=63$ are printed on the blank portion between the sprocket perforations 27 and the print format 22 of the print sheet 20 shown in FIG. 3. More specifically, the preprint data 24 is printed on the second digit print position of the print sheet 20. The preprint data serves to represent a test print operation of the dot pins 161 to 167. While a preprint operation is thus performed using the dot pins 161 to 167, any unnecessary ink and the like adhering between the dot pins 161 to 167 and a guide, not shown, can be removed.

When the central processing unit 1 determines at the above described step SP5 that the print digit signal is for the third or more significant digit position based on the count value of the counter 7, then at the step SP7 the central processing unit 1 determines whether the print digit signal is for the n-th digit position, where the n-th digit position represents the digit position where the final character can be printed in the print format 22 of the print sheet 20. If and when the print digit signal is not representative of the n-th digit position, then at the step SP8 the print control data of the characters being printed in the print digit position corresponding to the said print digit signal is read from the random access memory 3 and is fed through the input/output port 6 to the character generator 8. Then the character generator 8 provides the character data corresponding to the print control data. Then the printer driver 9 is responsive to the supplied character data to print the corresponding character in the print format 22 of the print sheet 20.

When the central processing unit 1 determines at the above described step SP7 that the print digit signal is for the n-th digit position, then at the step SP9 the print allowing signal shown as (G) in FIG. 4 becomes the low level, thereby to prevent the printer driver 9 from driving the print head 16. At that time, the print head 16 is moved rightward passing the n-th print digit position. When the print head 16 approaches the end position 26 of the print sheet 20, the end position sensor 11 detects the same, thereby to provide the detected signal to the central processing unit 1. When the central processing unit 1 determines at the step SP10 that the print head 16 comes to the end position, at the step SP11 a reverse rotation signal is applied to the motor driving circuit 12, whereby the motor 13 is reverse rotated. Therefore, the print head 16 is moved leftward as viewed in FIG. 3. When the print head 16 approaches the start position 25, the start position sensor 10 detects the same, thereby to provide the detected signal to the central processing unit 1. The central processing unit 1 determines at the step SP12 whether the print head 12 has reached the start position. Therefore, if and when the central processing unit 1 determines based on the detected signal from the start position sensor 10 that the print head 16 has reached the start position, then at the step SP13 the stop enabling signal is applied to the motor driving circuit 12. Accordingly, the motor driving circuit 12 stops the motor 13, thereby to terminate a print operation of one line on the print sheet 20.

Meanwhile, the above described embodiment was adapted such that all the dots of one character shown in FIG. 1, i.e. the seven dots in the column direction and the nine dots in the lateral direction are all printed. However, in the case of a smaller margin of the print format of the print sheet 20, if and when a preprint is performed while the print head 16 is moved, the print head 16 passes the margin portion and the first print digit position, which results in a fear that a character can not be printed at the first digit position of the print format 22. Therefore, in order to eliminate such fear, it becomes necessary that the print head 16 is returned to the start position after a preprint operation is performed. Therefore, now an embodiment which eliminates such inconvenience as described above while removing unrequired ink and the like adhering to the dot pins 161 to 167 will be described in the following.

Figure 7:
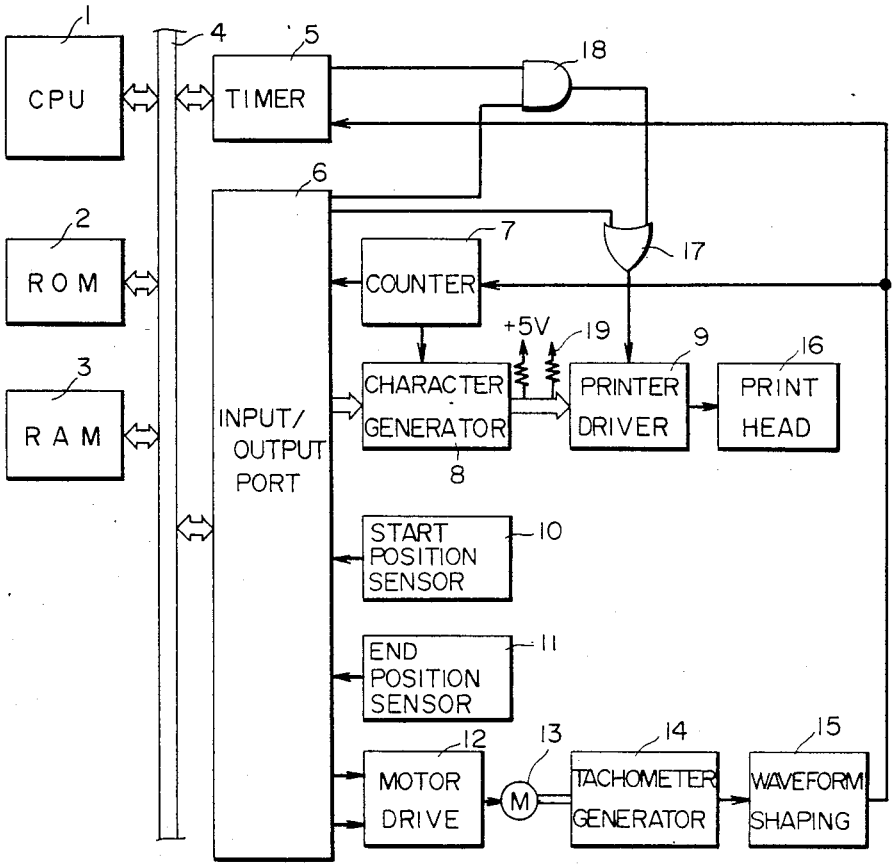
FIG. 7 is a block diagram of another embodiment of the present invention.

FIG. 7 is a block diagram of another embodiment of the present invention. It is pointed out that the FIG. 7 block diagram is substantially the same as the FIG. 2 embodiment, apart from the modification set forth in the following. More specifically, the print timing signal obtained from the timer 5 is applied to one input terminal of an AND gate 18. The other input of the AND gate 18 is connected to receive a print allowing signal from the input/output port 6. Accordingly, the AND gate 18 provides a print timing signal only when the print allowing signal is applied. The output signal of the AND gate 18 is applied through an OR gate 17 to the printer driver 9. The preprint signal is obtained from the input/output port 6 while the print head 16 is brought to a stop at the margin outside the print format 22 of the print sheet, 20. The preprint signal is applied through the OR gate 17 to the printer driver 9. Meanwhile, a pull-up resistor 19 is connected to the output terminal of the character generator 8 in order to make the output terminal a high impedance when no data is obtained from the character generator 8.

Figure 8:
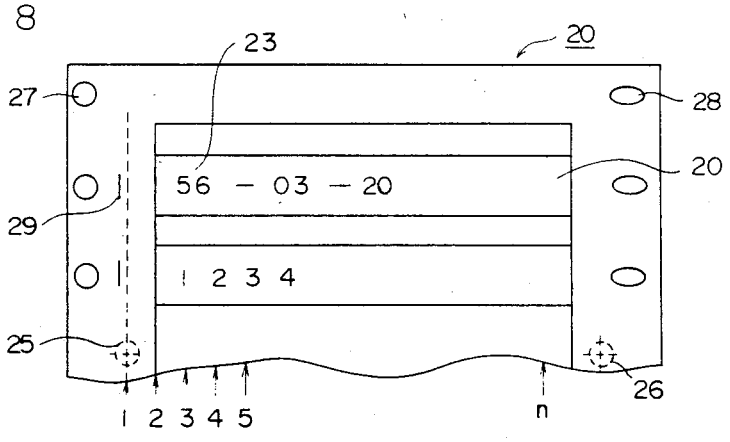
FIG. 8 is a view showing one example of a print sheet where data is printed in accordance with the other embodiment of the present invention.
Figure 9:
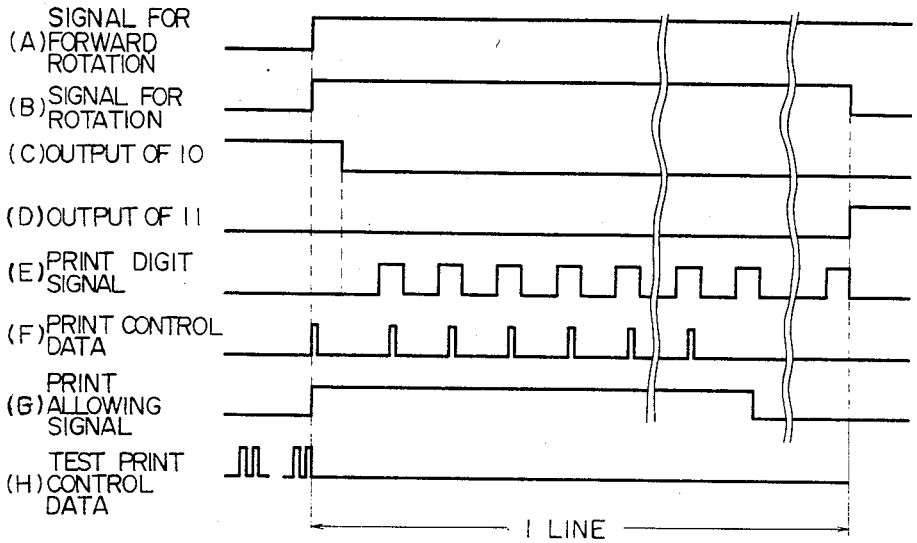
FIGS. 9 and 10 are graphs showing waveforms of the electrical signals at various portions in the FIG. 7 embodiment.
Figure 10:
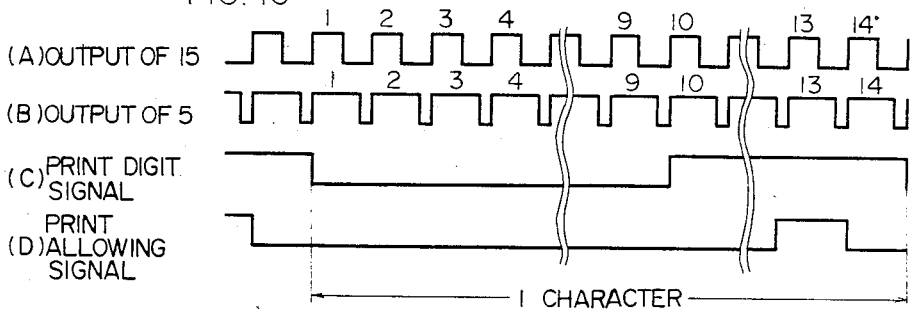
Figure 11A:
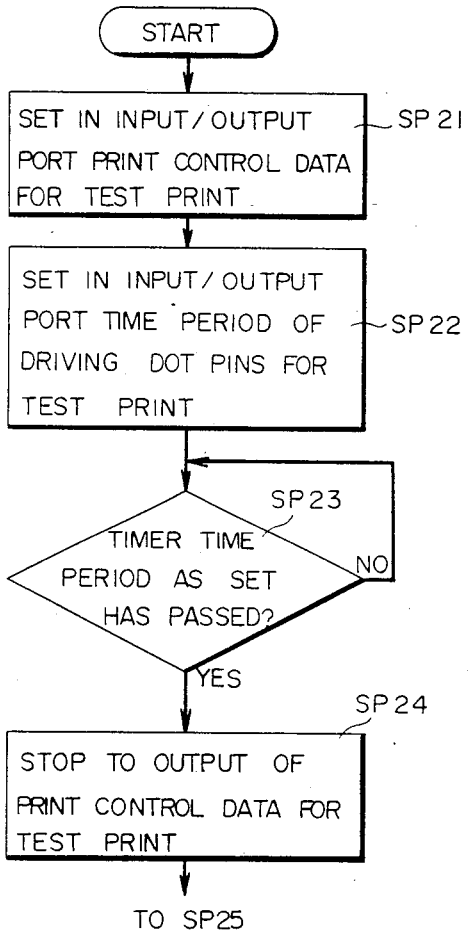
FIGS. 11A–11B show a flow diagram for explaining a specific operation of the other embodiment of the present invention.
Figure 11B:
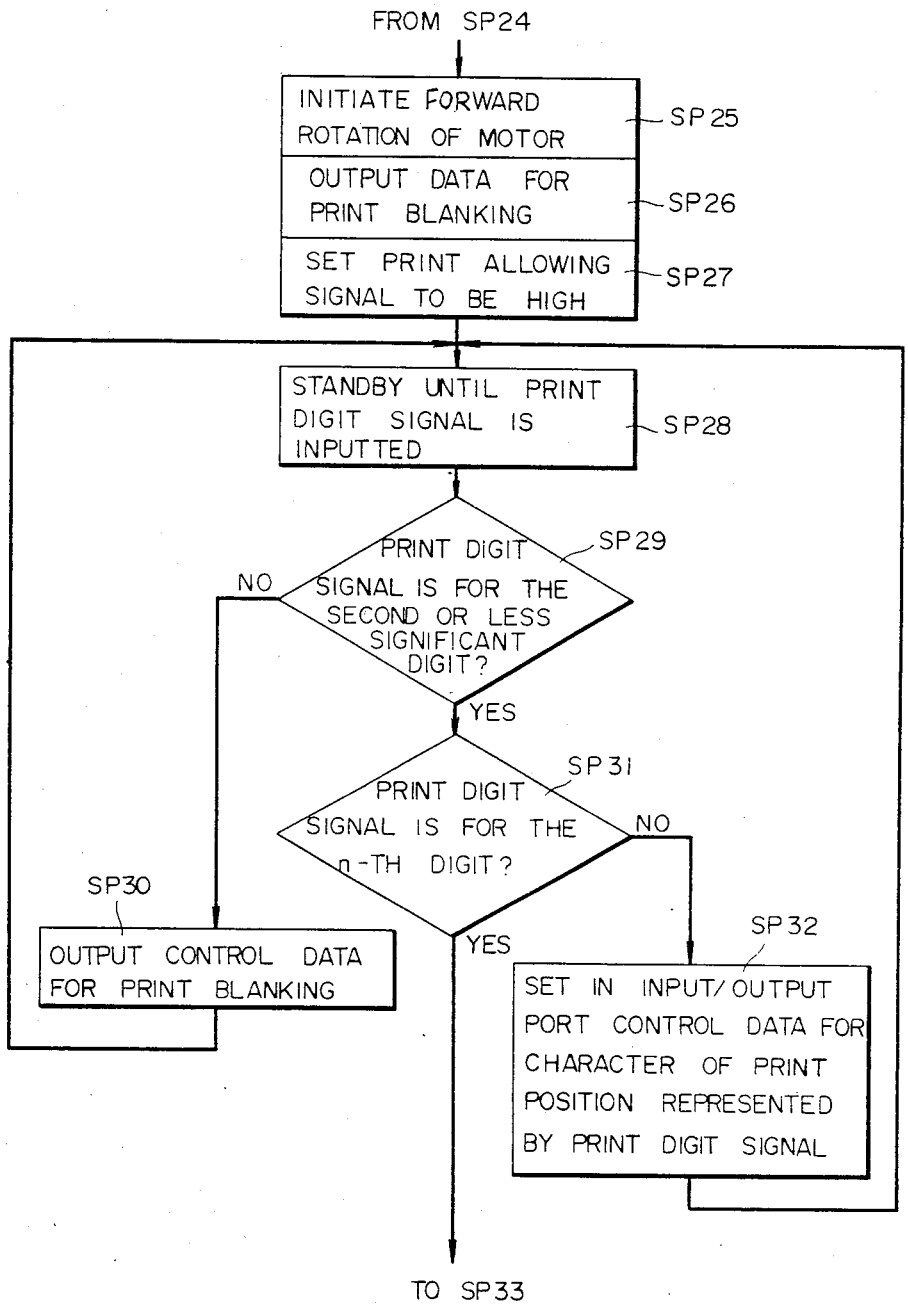
Figure 11C:
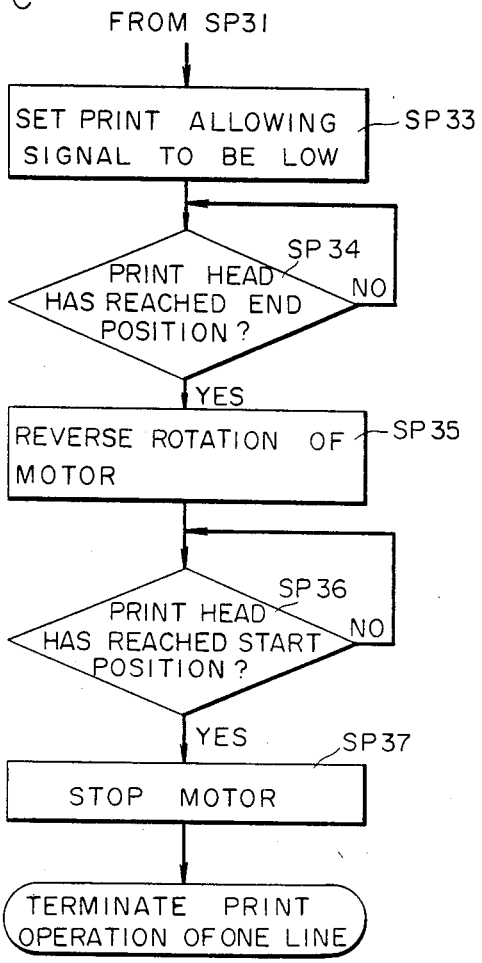

FIG. 8 is a view showing one example of the print sheet where the data has been printed in accordance with the other embodiment of the present invention, FIGS. 9 and 10 are graphs showing waveforms of the electrical signals at various portions in the FIG. 7 diagram, and FIG. 11 is a flow diagram for explaining a specific operation of the other embodiment of the present invention.

Now referring to FIGS. 7 to 11, an operation of the other embodiment of the present invention will be described. First the central processing unit 1 provides at the step SP21 the preprint signal as shown as (H) in FIG. 9 from the input/output port 6. At the step SP22, the central processing unit 1 causes the input/output port 6 to provide the print allowing signal. Accordingly, the input/output port 6 provides the preprint signal through the OR gate 17 to the printer driver 9 and also provides the print allowing signal to the AND gate 18. Then, the AND gate 18 provides the print timing signal obtained from the timer 5 through the OR gate 17 to the printer driver 9. Since the character generator 8 is not supplied with the print control data from the input/output port 6, the output is placed in a floating state. However, since the input of the printer driver 9 has been forced to the high level by the voltage supply through the pull-up resistor 19, it follows that the drive enabling signal for driving the respective dot pins 161 to 167 has been supplied. Accordingly, the printer driver 9 drives the respective dot pins 161 to 167 of the print head 16.

Now the central processing unit 1 determines at the step SP23 whether the preprint period has passed. Unless the preprint period has passed, continually the preprint signal is supplied from the input/output port 6 to the printer driver 9. Accordingly, the printer driver 9 continually drives the respective dot pins 161 to 167 responsive to the preprint signal. Since the motor 13 has been brought to a stop, the print head 16 has been stopped in the vicinity of the start position 25 of the print sheet 20. Accordingly, even if the respective dot pins 161 to 167 are driven several times by the printer driver 9, it follows that the respective dot pins 161 to 167 depresses the same positions in the vicinity of the start position 25 of the print sheet 20. Therefore, a print 29 of one column is performed on the print sheet 20 as shown in FIG. 8.

On the other hand, after the lapse of the preprint period, the central processing unit 1 stops the output of the preprint signal obtained from the input/output port 6 at the step SP24. Then, the central processing unit 1 performs at the steps 25 to 37 the same operations as done at the steps 1 to 13 as previously described in conjunction with FIG. 6.

As described foregoing, by performing a preprint operation before the first character is printed while the print head 16 is in a standstill state, unnecessary ink and the like adhering to the periphery of the respective dot pins 161 to 167 can be removed. In addition, since a preprint operation is performed while the print head 16 is in a standstill state, the print head 16 does not pass the first print digit position of the print format 22 during a preprint operation even in the case of a small margin of the print sheet 20 and therefore a character can be printed from the first print digit position following the preprint operation.

Meanwhile, if and when a preprint operation is performed outside the print format of the print sheet 20 before the first character is printed, as described above, a print out of dots having no meaning is left on the print sheet 20 and undesired print of dots is unsightly. This can be avoided by coating a printer sensitive coloring material within the area of the print format 22 of the print sheet 20 such that a portion depressed by the dot pins 161 to 167 becomes colored and by not coating such pressure sensitive coloring material in the area outside the print format (hatched portion in FIG. 12). By doing so, no print of undesired dots due to a preprint is left outside the print format 22 of the print sheet 20.

The above described embodiment can be applied to such a dot printer as making a print operation using an ink ribbon. For example, two of the print sheets 20 are layered and a print operation is performed by depressing the ink ribbon with the dot pins 161 to 167 on the first layered print sheet 20. On the other hand, a print sheet of the embodiment now in description is used as the second layered print sheet, so that the print out on the first layered print sheet may be pressure sensitively copied. In such a case, while the first layered print sheet has a preprint out left thereon, the second layered print sheet has nothing left as a result of preprint. Therefore, the first layered print sheet may be used for issuer's file without any serious problem due to such unsightly preprint. Since the second layered print sheet has no preprint appearing, the same may be used for customer's file.

Figure 12:
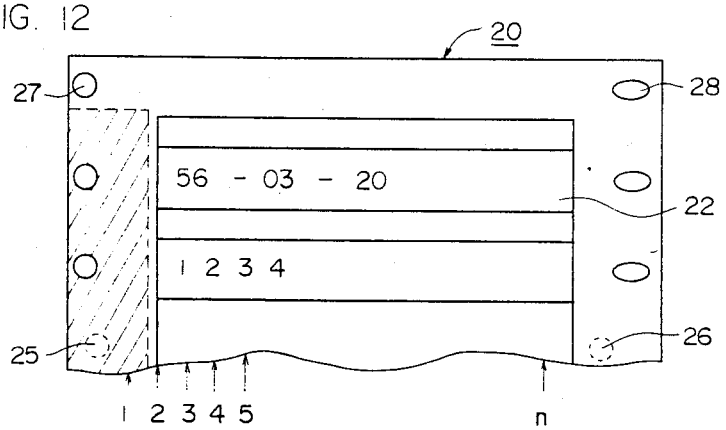
FIG. 12 is a view showing one example of a print sheet for use in a further embodiment of the present invention.

In the above described embodiment, a print sheet of such a specific design as shown in FIG. 12 was employed to avoid an unsightly print out of a preprint. However, such unsightly print out due to a preprint can also be avoided by controlling a driving method of the dot pins 161 to 167. In the following, therefore, an embodiment for such purpose will be described.

Figure 13:
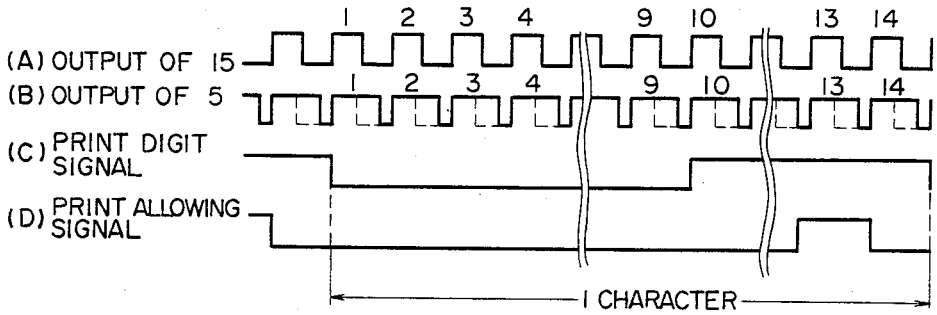
FIG. 13 is a time chart for explaining the further embodiment of the present invention.
Figure 14:
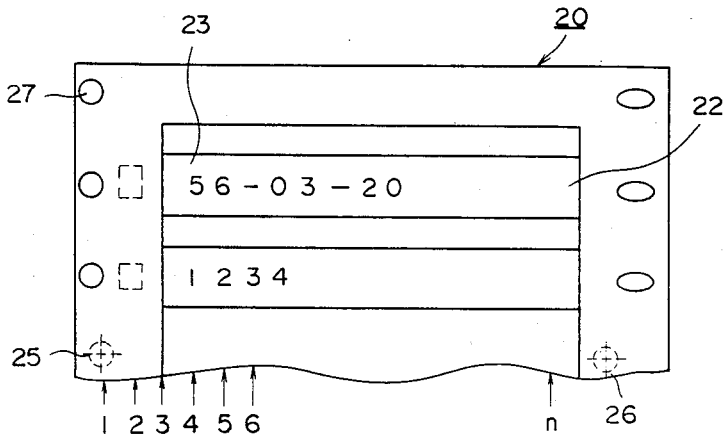
FIG. 14 is a view showing one example of a print sheet where the data is printed in accordance with the further embodiment of the present invention.

FIG. 13 is a time chart for explaining such further embodiment of the present invention. FIG. 14 is a view showing one example of a print sheet where the data has been printed in accordance with the further embodiment of the present invention.

Figure 6A:
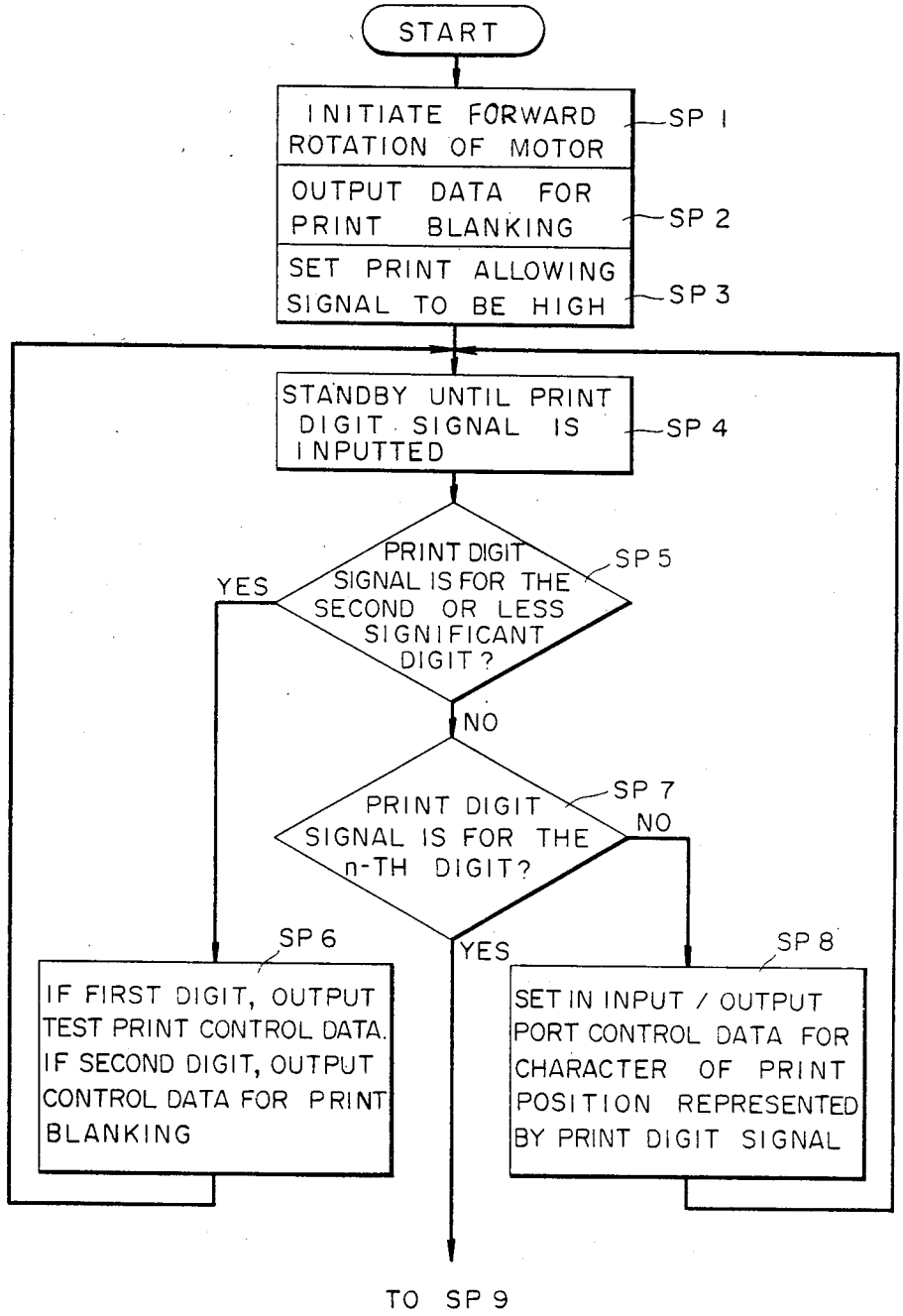
FIGS. 6A and 6B show a flow diagram for explaining a specific operation of one embodiment of the present invention.
Figure 6B:
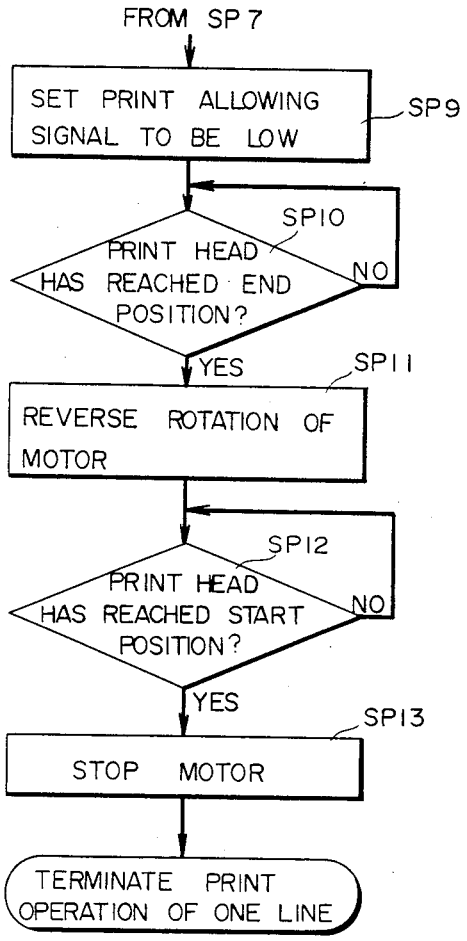

Referring to the FIG. 6 flow diagram described previously, at the steps SP2 and SP3, the central processing unit 1 evaluates a period of approximately one-third of the normal print timing period, thereby to set the same in the timer 5. More specifically, the timer 5 is loaded with the data of the time period of approximately one-third of the driving period required for printing a character by depressing the dot pins 161 to 167 onto the print sheet 20, as shown as (B) in FIG. 13. Then at the step SP6 shown in FIG. 6, a preprint operation is performed. Since a driving force of approximately one-third of the driving force required for printing a character by depressing the dot pins 161 to 167 onto the print sheet 20 is applied to the dot pins 161 to 167, the dot pins 161 to 167 are driven toward the print sheet 20 but with an insufficient force, with the result that the dot pins 161 to 167 are brought to a stop immediately before depression of the print sheet 20. Therefore, as shown in FIG. 14, ink and the like adhering to the dot pins 161 to 167 can be removed without leaving a print out due to a preprint.

A preprint operation can also be performed without leaving a dot print out in accordance with the embodiment described previously in conjunction with FIGS. 7 to 11. More specifically, when the preprint signal is obtained from the input/output port 6 at the step SP21 shown in FIG. 11, the value of approximately one-third of the period required for depression of the print sheet 20 by the dot pins 161 to 167 is evaluated and the same is set in the input/output port 6. Then the print timing signal of the pulse width of approximately one-third of the pulse width of the normal print timing signal is obtained based on the value set in the input/output port 6. By doing so, a preprint signal applied to the printer driver 9 has the pulse width of approximately one-third of that of the normal print timing signal and therefore the dot pins 161 to 167 are brought to a stop immediately before depression of the print sheet 20. As a result, according to the embodiment now in description, unnecessary ink and the like adhering to the dot pins 161 to 167 can be removed without leaving any print out of dots while the print head 16 is in a standstill state.

Meanwhile, although the above described embodiments were adapted such that a preprint operation is performed immediately before a character is printed at the first digit position of the print format 22 of the print sheet 20, the embodiment may be adapted such that a preprint operation is performed only immediately before the first character is printed at the first line of each print sheet 20.

The above described pulse width of approximately one-third of the normal print timing signal was determined empirically. Therefore, it could happen that the dot pins 161 to 167 does not stop immediately before depression of the print sheet 20 and hence a slight depression of the print sheet 20 causes an undesired dot print out to be left in spite of the fact that a print timing signal of the above described pulse width is applied to the print head 16. On the other hand, such unnecessary dot print out due to a preprint operation even outside the print format is not preferred inasmuch as such print sheet 20 should be kept as evidence of a transaction. Therefore, one approach can be thought of that if a preprint operation outside the print format has left even a slight dot print out there, a print operation of character is thereafter prevented. Now an embodiment employing such approach will be described in the following.

Figure 15:
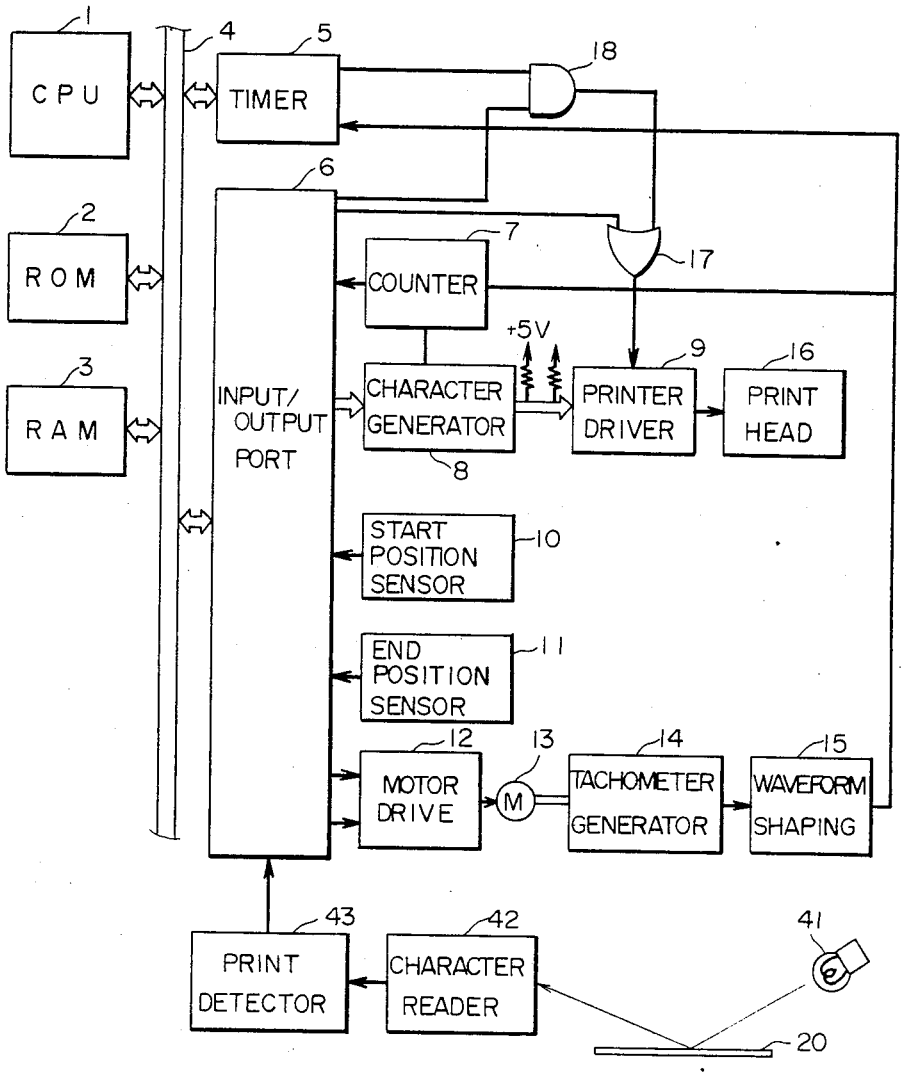
FIG. 15 is a block diagram of the further embodiment of the present invention.

FIG. 15 is a block diagram of such further embodiment of the present invention. It is pointed out that the FIG. 15 embodiment is similar to the FIG. 7 embodiment, apart from the modification set forth in the following. More specifically, a light source 41 for illuminating the margin outside the print format 22 of the print sheet 20, and a character reader 42 for reading the light beam as reflected from the print sheet 20 are provided. Accordingly, if and when even a slight dot print out is left at the margin outside the print format as a result of a preprint operation, the reflected light beam from the dot print out is read by the character reader 42. The read signal from the character reader 42 is applied to a print detector 43. The print detector 43 is responsive to the read output from the character reader 42 to determine whether a dot print out is left at the margin outside the print format 22 of the print sheet 20. The detected output from the print detector 43 is applied through the input/output port 6 to the central processing unit 1.

Figure 16:
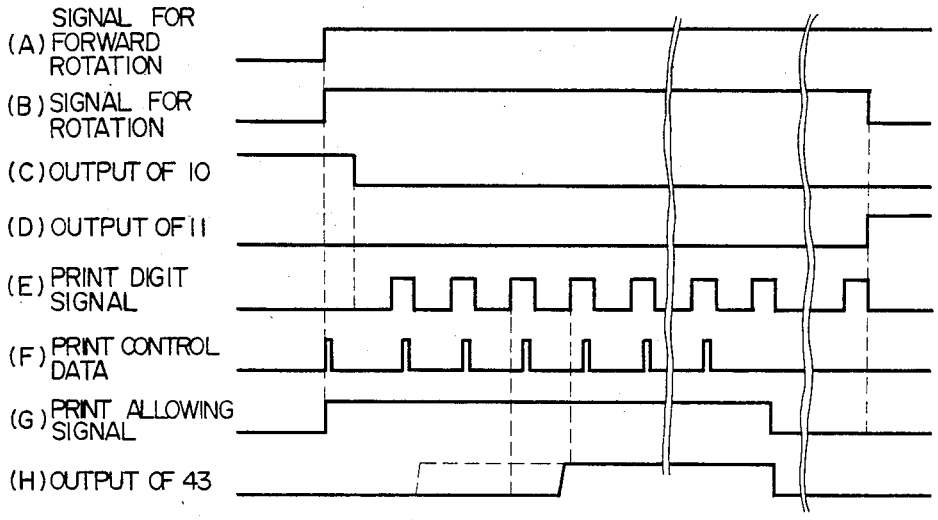
FIG. 16 is a flow diagram for explaining an operation of the FIG. 15 embodiment.
Figure 17A:
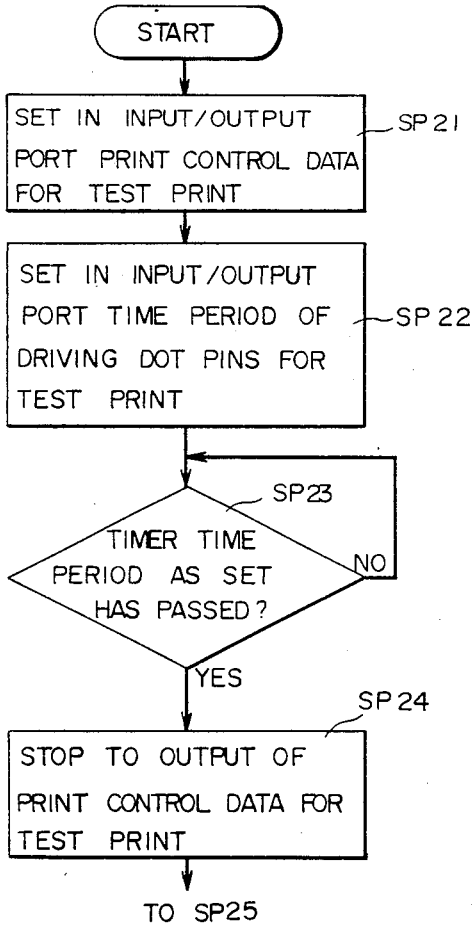
FIGS. 17A–17B show a flow diagram for explaining an operation of the further embodiment of the present invention.
Figure 17B:
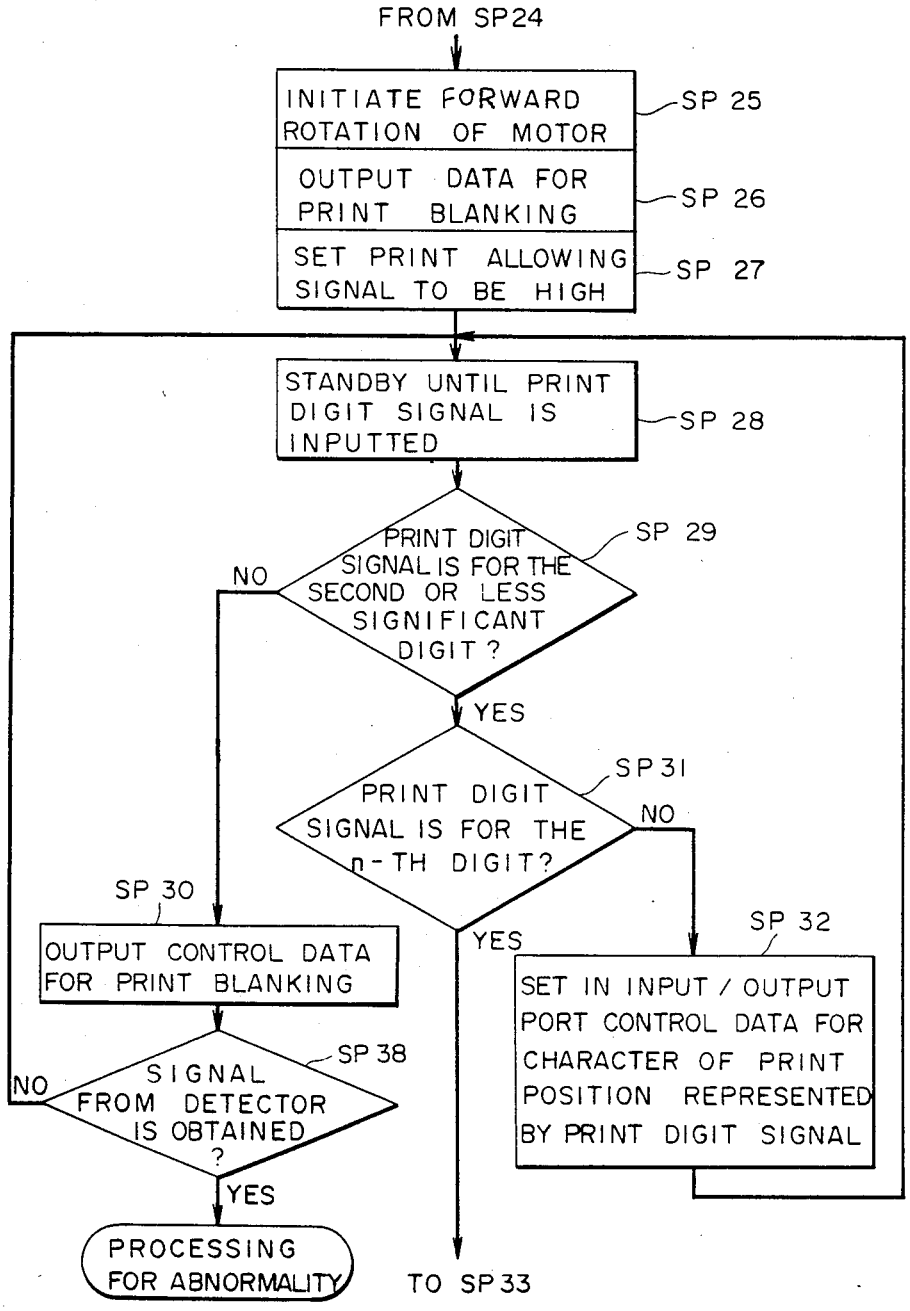
Figure 17C:
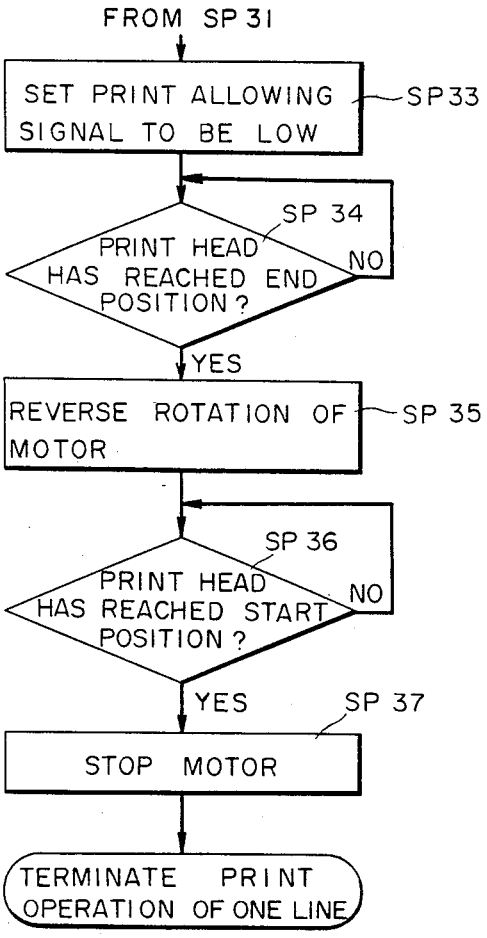

FIG. 16 is a flow diagram for explaining an operation of the FIG. 15 embodiment and FIG. 17 is a flow diagram for explaining an operation of the further embodiment of the present invention. Now referring to FIGS. 15 to 17, a specific operation of the above described further embodiment of the present invention will be described. The FIG. 17 flow diagram is substantially the same as the FIG. 11 embodiment, apart from the step SP39. As described previously, a preprint operation is performed by the print head 16 in response to the print timing signal of the pulse width of approximately one-third of that of the normal print timing signal. Now let it be assumed that due to a variation of the ambient temperature, for example, the dot pins 161 to 167 are not stopped immediately before depression of the print sheet 20, whereby even a slight dot print is left at the margin outside the print format. On the other hand, the character reader 42 reads the light beam from the light source 41 as reflected by the print sheet 20 and the read signal is applied to the print detector 43. The print detector 43 determines whether a dot print out has been left in the margin portion outside the print format 22 of the print sheet 20. If there is any dot print out left, the detected signal representing the same is applied through the input/output port 6 to the central processing unit 1. On the other hand, when the central processing unit 1 determines at the step SP29 that the print digit signal is for the first digit position, then at the step SP30 the print data is blanked. Then at the step SP39, it is determined whether the detected signal is obtained from the print detector 43. The print detected signal becomes of a waveform as shown by the dotted line in the case where a dot print out has been left due to a preprint operation, and becomes of a waveform shown by the solid line in the absence of any dot print out, as shown as (H) in FIG. 16. Accordingly, if and when the print detected signal is of a waveform shown by the dotted line as (H) in FIG. 16, the central processing unit 1 proceeds to the step SP28 to be in a standby state until the next print digit signal is received and, when the next print digit signal is received, prints out the first character within the print format 22. However, if and when the central processing unit 1 determines at the step SP39 that there is a dot print out left, abnormality processing is performed. By way of one example of such abnormality processing, the print sheet 20 having a dot print out left due to a preprint operation is withdrawn and a new print sheet 20 is set, whereupon further characters are printed without making a preprint operation. Any other modifications could be made by those skilled in the art.

Thus, according to the embodiment, issuance of a print sheet 20 having undesired dot print out due to a preprint operation can be prevented.

Meanwhile, the embodiment shown in FIGS. 1 to 5 may be embodied such that the above described light source 41, the character reader 42 and the print detector 43 are provided and, when a preprint operation is performed outside the print format region of the print sheet 20 and the print out is detected, characters are allowed to be printed within the print format region 22.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dot printer for printing a character in the form of a dot pattern formed by an arrangement of dots in a matrix which includes a plurality of dots in a first direction and a plurality of dots in a second direction, said dots being printed on a print medium having a predetermined print region where a predetermined number of characters can be printed in said second direction, said printer comprising:

a print head including a plurality of dot pins arranged in said first direction, means for causing relative movement between said print head and said print medium in said second direction, dot pin driving control means for selectively driving said dot pins toward said print medium for depressing said print medium with said dot pins during said relative movement between said print head and said print medium, whereby said character is printed in the form of said dot pattern, means for removing adhering particles from said dot pins, said removing means including predriving force applying means for applying to said dot pins a predriving force at a position before a first position to be printed, whereby malfunction in printing caused due to ink adhering to the dot pins can be prevented, said predriving force applying means comprising means for applying to said dot pins said predriving force at a region outside of said print medium;

character reading means for reading characters printed on said print sheet, and determining means responsive to the output from said character reading means for determining whether there is a print out in a region outside said print region of said print medium, said determining means comprising means responsive to determination of said print out for inhibiting a print out of said characters.

2. A dot printer for printing a character on a print medium in the form of a dot pattern formed by an arrangement of dots in a matrix which includes a plurality of dots in a first direction and a plurality of dots in a second direction, comprising:

a print head including a plurality of dot pins arranged in said first direction, means for causing relative movement between said print head and said print medium in said second direction, dot pin driving control means for selectively driving said dot pins toward said print medium for depressing said print medium with said dot pins during said relative movement between said print head and said print medium, whereby said character is printed in the form of said dot pattern, and means for clearing said dot pins of adhering material including means for applying a driving force to each of said plurality of pins while said driving pins are in a position opposite said print medium, said driving force being smaller than necessary to cause depression of said print medium by said dot pins.

3. A dot printer in accordance with claim 2, wherein said predriving force applying means comprises means for applying to said dot pins said predriving force during a time period shorter than the time period required for printing said character through depression of said print medium by said dot pins.

4. A dot printer in accordance with claim 2, wherein said predriving force applying means comprises means for applying to said dot pins said predriving force during a time period shorter than the time period required for printing said character through depression of said print medium by said dot pins.

5. A dot printer in accordance with claims 2 wherein said print medium has a predetermined print region where a predetermined number of characters can be printed in said second direction, and said predriving force applying means comprises means for applying to said dot pins said predriving force at a region at the margin portion of said print medium.

6. A dot printer in accordance with claim 5, wherein said driving force applying means comprises means for applying to said dot pins said predriving force while said print head is being moved in said second direction.

7. A dot printer in accordance with claim 5, wherein said predriving force applying means comprises means for applying to said dot pins said predriving force while said print head is placed in a standstill state.

8. A dot printer in accordance with claim 6 wherein said print medium comprises a plurality of said predetermined print regions in said first direction, said predriving force applying means comprises means for applying to said dot pins said predriving force before the first character is printed within the first print region out of said plurality of print regions.

9. A dot printer in accordance with claim 8, wherein said predriving force applying means comprises means for applying to said dot pins said predriving force before the first character is printed in the first region of each print region.

10. A dot printer in accordance with claim 5, which further comprises character reading means for reading characters printed on said print sheet, and determining means responsive to the output from said character reading means for determining whether there is a print out at the margin portion of said print medium.

11. A dot printer in accordance with claim 10, wherein said character reading means comprises means for reading characters optically.

12. A dot printer in accordance with claim 7 wherein said print medium comprises a plurality of said predetermined print regions in said first direction, said predriving force applying means comprises means for applying to said dot pins said predriving force before the first character is printed within the first print region out of said plurality of print regions.

13. A dot printer in accordance with claim 12, wherein said predriving force applying means comprises means for applying to said dot pins said predriving force before the first character is printed in the first region of each print region.

* * * * *